US007197792B2

(12) United States Patent
Moon

(10) Patent No.: US 7,197,792 B2
(45) Date of Patent: Apr. 3, 2007

(54) DOOR HANDLE FOR REFRIGERATOR

(75) Inventor: Sun-Nam Moon, Sancheong-gun (KR)

(73) Assignee: LG Electronics Inc., Seoul City (CN)

( * ) Notice: Subject to any disclaimer, the term of this patent is extended or adjusted under 35 U.S.C. 154(b) by 0 days.

(21) Appl. No.: 11/200,061

(22) Filed: Aug. 10, 2005

(65) Prior Publication Data

US 2006/0032023 A1 Feb. 16, 2006

(30) Foreign Application Priority Data

Aug. 11, 2004 (KR) ..... 10-2004-0063281

(51) Int. Cl.
*B25G 1/10* (2006.01)

(52) U.S. Cl. ..... 16/436; 16/412; 16/415; 16/DIG. 41

(58) Field of Classification Search ..... 16/436, 16/440, 412, 413, 415, 416, 444, DIG. 41, 16/DIG. 40; 403/381, 387; 312/348.6, 401, 312/405, 244, 245, 247; 49/460, 461
See application file for complete search history.

(56) References Cited

U.S. PATENT DOCUMENTS

| | | | | | |
|---|---|---|---|---|---|
| 2,175,632 | A * | 10/1939 | Maga | ..... | 16/422 |
| 2,731,662 | A * | 1/1956 | Mills | ..... | 16/412 |
| 3,156,944 | A * | 11/1964 | Bohn | ..... | 16/412 |
| 3,197,803 | A * | 8/1965 | Williamson | ..... | 16/416 |
| 4,087,141 | A * | 5/1978 | Roberts | ..... | 312/348.6 |
| 5,727,858 | A * | 3/1998 | Shapiro | ..... | 312/348.6 |
| 5,860,538 | A * | 1/1999 | Duero et al. | ..... | 211/123 |
| 5,890,261 | A * | 4/1999 | Mantarakis | ..... | 16/413 |
| 6,430,780 | B1 * | 8/2002 | Kim et al. | ..... | 16/412 |
| 2003/0056334 | A1 * | 3/2003 | Finkelstein | ..... | 16/436 |

FOREIGN PATENT DOCUMENTS

| | | | |
|---|---|---|---|
| DE | 3940137 | A1 * | 6/1991 |
| DE | 19650776 | A1 * | 6/1998 |
| DE | 10259328 | A1 * | 7/2003 |
| DE | 10303734 | A1 * | 8/2004 |
| JP | 2003050081 | A * | 2/2003 |

* cited by examiner

*Primary Examiner*—Chuck Y. Mah
(74) *Attorney, Agent, or Firm*—Birch, Stewart, Kolasch & Birch, LLP

(57) ABSTRACT

The present invention relates to a door handle for a refrigerator. According to the present invention, a bar holder 41 of a door handle 40 includes a fixing portion 42 fixed to a front surface of a refrigerator door 30 and a coupling portion 44 coupled to an upper or lower end of a handle bar 47. Fitting grooves 44*a* are formed in both sides of the coupling portion 44, whereas fitting ribs 47*a*, which are fitted into the fitting grooves 44*a* downward or upward, are provided on both sides of the upper or lower end of the handle bar 47. At this time, the upper and lower ends of the handle bar 47 are supported by the upper and lower coupling portions 44, respectively. According to the present invention so configured, the number of parts of the door handle can be decreased, the assembly of the door handle can be simplified, and an error occurring in the manufacturing process can be corrected.

16 Claims, 5 Drawing Sheets

DOOR HANDLE FOR REFRIGERATOR

BACKGROUND OF THE INVENTION

1. Field of Invention

The present invention relates to a refrigerator, and more particularly, to a door handle for a refrigerator which a user grips to apply a force for opening and closing a refrigerator door.

2. Description of the Prior Art

FIG. 1 shows a door mounted with a door handle according to a prior art.

As shown in the figure, a door handle 20 is provided on a portion of a front surface of a door 10 for selectively opening and closing a storage space of a refrigerator. The door handle 20 is a part which a user grips and pulls or pushes the door handle 20 to open and close the door 10. The door handle 20 comprises a pair of bar holders 21, a handle bar 27, and a plurality of screws Sa and Sb used for fastening the bar holders 21 and the handle bar 27 to the door 10 and the bar holders 21, respectively.

Each of the bar holders 21 supports the handle bar 27 in a state where the bar holders 21 are fixed to a side of the door 10. The bar holder 21 is composed of a fixing portion 22 and a seating portion 24. The fixing portion 22 is brought into close contact with the side of the door 10 and formed with a fastening hole 22*a* through which the screw Sa is fastened to the side of the door 10.

The seating portion 24 is fastened to an upper or lower end of the handle bar 27. An upward or downward extending fastening piece 25 is provided at a distal end of the seating portion 24 such that it can be inserted into the handle bar 27. The fastening piece 25 is formed with a fastening hole 25*a* to which the screw Sb penetrating a side surface of the door handle 20 is fastened.

Furthermore, the handle bar 27 extends in a vertical direction and is formed into a hollow cylinder of which upper and lower ends are opened. In a state where the upper and lower ends of the handle bar 27 are seated in the seating portions 24, the screws Sb penetrating the handle bar 27 are fastened to the fastening holes 25*a* of the fastening pieces 25, so that the handle bar 27 is fixed to the bar holders 21. The screws Sb fastened to the fastening holes 25*a* of the fastening pieces 25 penetrate the portions of the handle bar 27 adjacent to a front surface of the door 10, i.e., the portions which are not visible from the front of the door 10.

In addition, in a state where the screws Sa penetrating the fastening holes 22*a* of the fixing portions 22 are fastened to the side of the door 10, covering caps (not shown) are installed to prevent the screws Sa from being exposed to the outside. The shelter caps are preferably formed of the same material as the fixing portions 22.

However, the door handle for a refrigerator according to the prior art has the following problems.

As described above, four screws, including two screws Sa for fixing the bar holders 21 to the door 10 and two screws Sb for fixing the handle bar 27 to the bar holders 21, are needed in the prior art. In addition, the additional covering caps for preventing the screws Sa from being exposed to the outside should be provided. Therefore, there is a disadvantage in that the costs of the door handle are increased due to the increase in the number of parts of the door handle.

Further, since the processes of fastening the screws Sb to fix the handle bar 27 to the bar holders 21 and installing the covering caps are required, the man-hour needed for the manufacture of the door handle is increased, and thus, the production costs are also increased.

Furthermore, since the handle bar 27 is fixed to the bar holders 21 by means of the screws Sb, the relative position of the handle bar 27 with respect to the bar holders 21 cannot be adjusted when the bar holders 21 are fixed to the side of the door 10. Therefore, when an error occurs in the size of the bar holders 21 or handle bar 27, it cannot be corrected.

SUMMARY OF THE INVENTION

Accordingly, the present invention is conceived to solve the aforementioned problems in the prior art. An object of the present invention is to provide a door handle for a refrigerator configured to have the reduced number of parts of the door handle.

Another object of the present invention is to provide a door handle for a refrigerator of which the man-hour needed for assembly works is minimized.

A further object of the present invention is to provide a door handle for a refrigerator easy to correct tolerance.

According to an aspect of the present invention for achieving the objects, there is provided a door handle for a refrigerator, comprising: a pair of bar holders each including a fixing portion fixed to an upper or lower portion on a side of a door and a coupling portion extending from the fixing portion; a vertically extending handle bar including upper and lower ends into which the coupling portions are inserted and coupled; and fixing means including fitting grooves and fitting ribs provided respectively in the bar holders and on the handle bar at positions corresponding to each other to fix the bar holders to the handle bar, such that any ones of the fitting grooves and fitting ribs are vertically fitted into or around the others when the coupling portions are inserted into the upper and lower ends of the handle bar.

Preferably, the fitting grooves are formed by cutting away both sides of the coupling portion adjacent to the fixing portion in a predetermined shape, and the fitting ribs are formed to protrude, in a shape corresponding to the fitting groove, from both ends of the cutaway portion of the upper or lower end of the handle bar, into which the coupling portion is inserted.

The fitting ribs and the fitting grooves may be formed to extend in a longitudinal direction of the handle bar.

Preferably, a seating step is formed in each of the cutaway portions of the handle bar to be brought into close contact with a side of the coupling portion and supports a surface of the bar holder in a state where the coupling portions are inserted into the upper and lower cutaway portions of the handle bar such that the fitting ribs are fitted into the fitting grooves.

More preferably, a fastening hole is formed in a door contact surface of the fixing portion of each bar holder brought into close contact with the door, and the bar holder is fixed to the door by fastening a fastener into the fastening hole from the rear to the front of the door in a state where the door contact surface is brought into close contact with the upper or lower portion on a side of the door.

The bar holders may be mounted on a front surface of the door.

Preferably, in a state where the bar holders are fixed to the door, the fixing portion of the bar holder extends to protrude from a front surface of the door, and the coupling portion of the bar holder extends to be curved at a predetermined angle with respect to the fixing portion in a direction away from a free end of the door.

Preferably, the handle bar is hollow cylindrical.

Preferably, the width of cutaway portions 47' is a half of circumference of handle bar.

According to the door handle for a refrigerator of the present invention so configured, there are advantages in that the production costs can be reduced due to the decrease in the number of parts of the door handle and the man-hour needed for assembly works and the poor assembly can be minimized due to easy tolerance correction during the assembly.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a door handle for a refrigerator according to the present invention will be described in detail with reference to the accompanying drawings.

Figure 1:
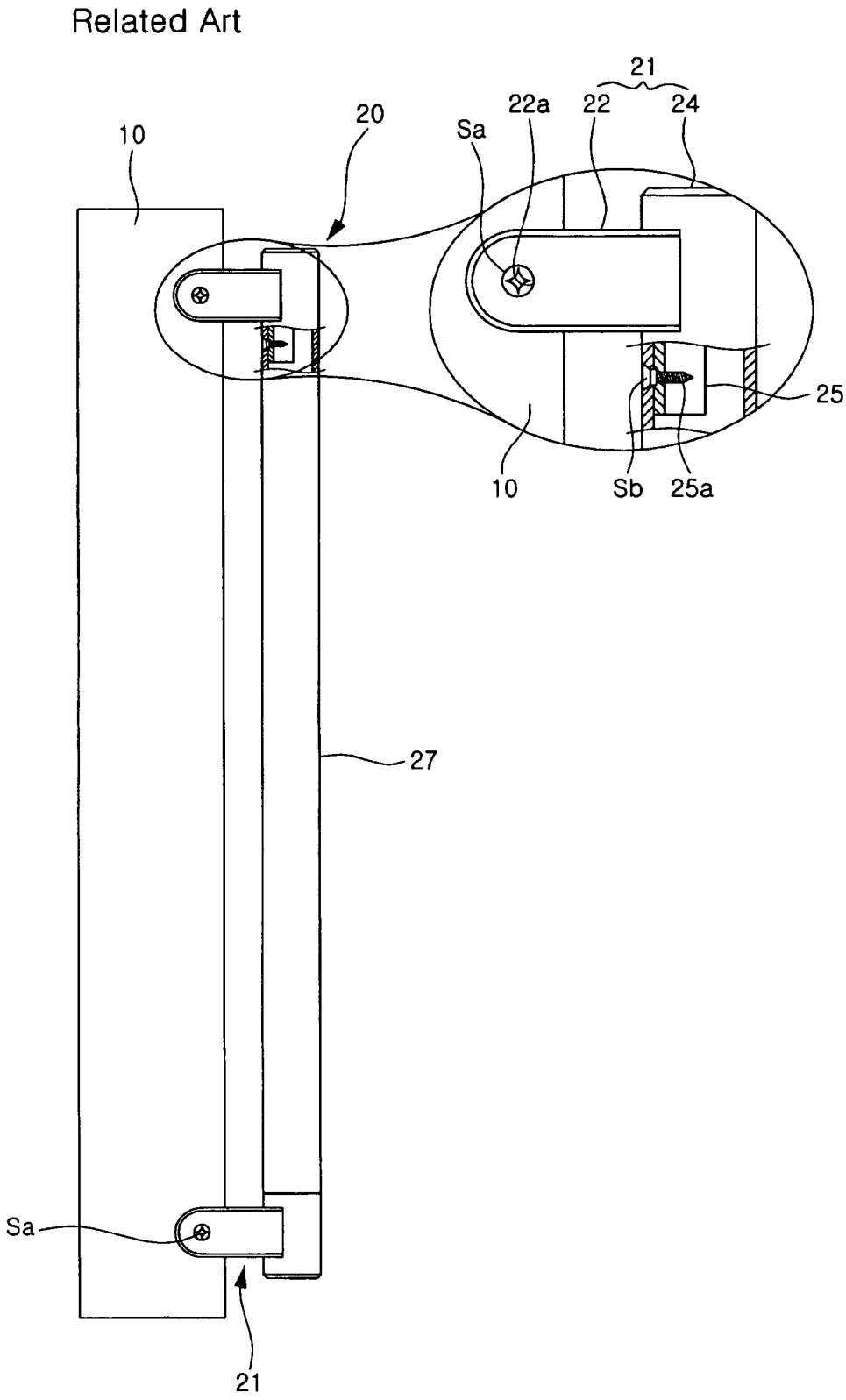
FIG. 1 is a partially sectional view showing a side of a door mounted with a door handle according to a prior art.
Figure 2:
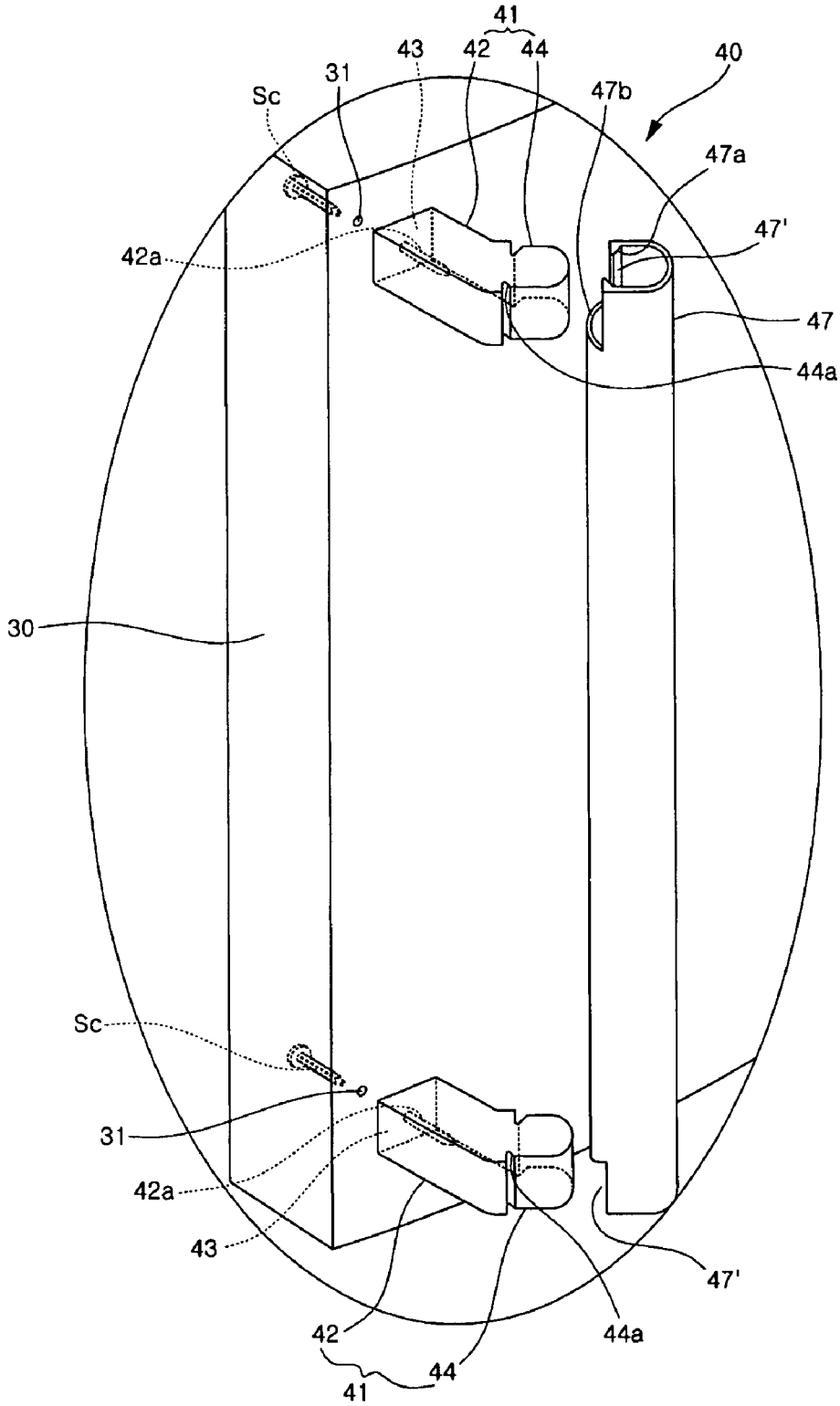
FIG. 2 is an exploded perspective view showing a preferred embodiment of a door handle for a refrigerator according to the present invention.
Figure 3:
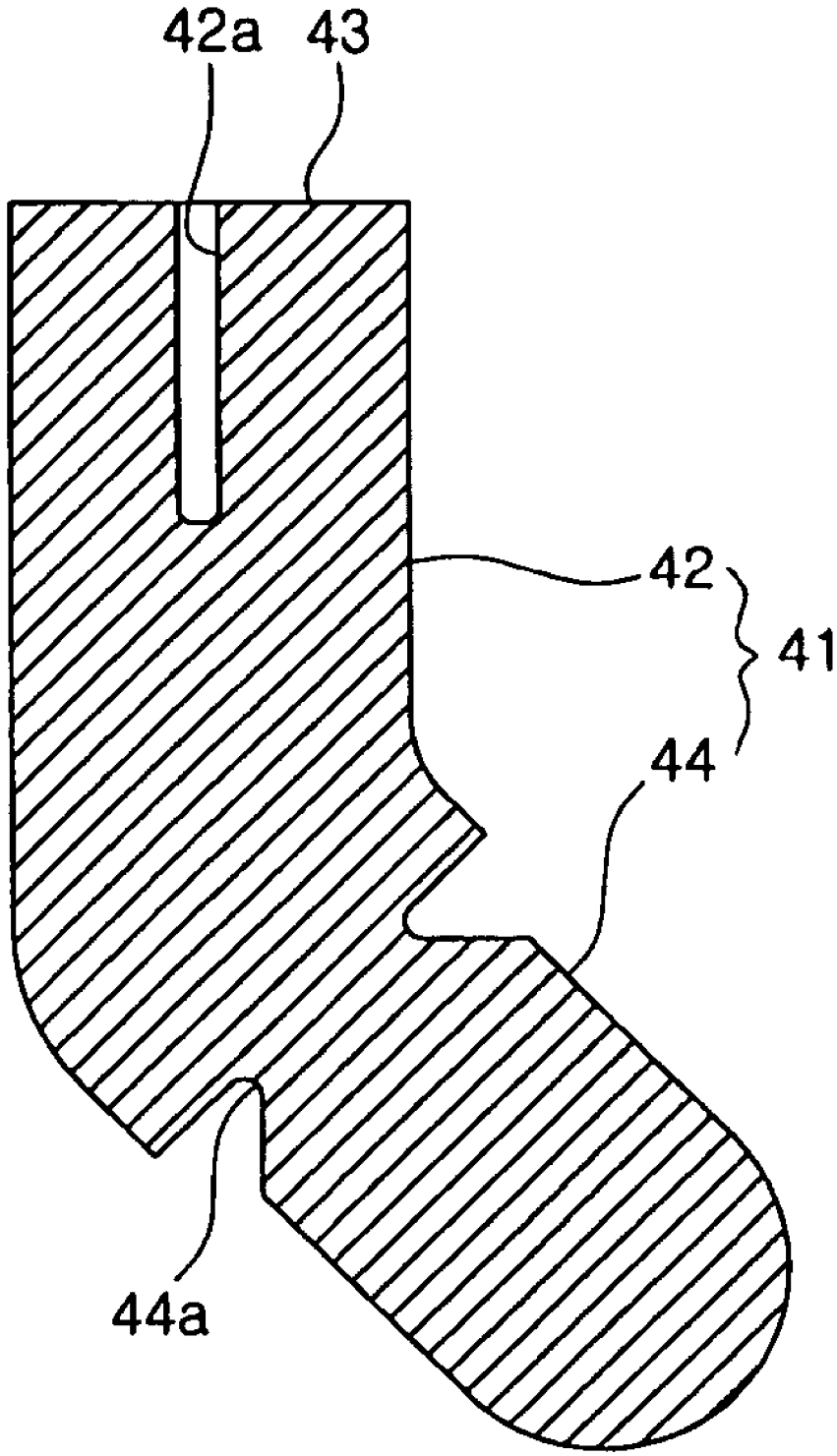
FIG. 3 is a cross-sectional view showing a bar holder of the embodiment shown in FIG. 2.

FIG. 2 is an exploded perspective view showing the preferred embodiment of the door handle for a refrigerator according to the present invention, and FIG. 3 is a cross-sectional view showing a bar holder of the embodiment shown in FIG. 2.

As shown in the figures, a refrigerator door 30 is provided with a door handle 40 which a user grips to apply a force needed for opening and closing the refrigerator door 30. Each of a pair of bar holders 41 of the door handle 40 includes a fixing portion 42 fixed to an upper or lower portion on one side of the front surface of the door 30 and a coupling portion 44 extending forward to the door 30 from the fixing portion.

The fixing portion 42 has a door contact surface 43 which is brought into close contact with the side on the front surface of the door 30. A fastening hole 42*a* extending into the fixing portion 42 is formed in the door contact surface 43. The fastening hole 42*a* is used to fasten the fixing portion 42 to the front surface of the door 30. A screw Sc is fastened from the rear to the front of the door 30 into the fastening hole 42*a* through a fastening hole 31 formed in the front surface of the door 30. For reference, two or more screws Sc may be fastened into two or more fastening holes 42*a*. The number of fastening holes can vary according to the design conditions of the bar holder 41.

Each of the coupling portions 44 extends from another surface of the fixing portion 42 opposite to the door contact surface 43. The coupling portions 44 are coupled to upper or lower ends of a handle bar 47, respectively, to serve to fix the handle bar 47 to the bar holders 41. The coupling portions 44 are interference-fitted to the upper and lower ends of the handle bar 47 such that the coupling portions 44 and the handle bar 47 do not inadvertently move with respect to each other when they are coupled with each other.

Here, the coupling portion 44 is curved to extend at a predetermined angle with respect to an extending direction of the fixing portion 42. The reason that the coupling portion 44 is curved at the predetermined angle is that a general aesthetic sense of the door handle 40 can be improved and a user's hand is not brought into contact with a wall surface and the like adjacent to the refrigerator while a user opens or closing the door 30. That is, since a portion to which the handle bar 47 is coupled is displaced from a free end side to the hinged side of the door 30, the user's hand does not collide with other portions adjacent to the free end side of the door 30.

Fitting grooves 44*a* are formed at both sides of each coupling portion 44 adjacent to the fixing portion 42, respectively. Since fitting ribs 47*a* to be described later are fitted into the fitting grooves 44*a* in a state where the coupling portions 44 are fitted into the upper and lower ends of the handle bar 47, the fitting grooves 44*a* serve to prevent the handle bar 47 from moving in the fore and aft direction of the door 30. In the illustrated embodiment, the fitting grooves 44*a* are formed by cutting away both the sides of each coupling portion 44 in a predetermined shape. The fitting grooves 44*a* are formed to extend in a longitudinal direction of the handle bar 47.

The coupling portions 44 are fitted into the upper and lower ends of the handle bar 47. The vertically extending handle bar 47 is a part that a user substantially grips to open and close the door 30. The handle bar 47 is preferably hollow cylindrical and made of the same material as the bar holders 41.

Cutaway portions 47' are formed at the upper and lower ends of the handle bar 47, respectively. The cutaway portions 47' are formed by partially cutting away the upper and lower ends of the handle bar 47 in a longitudinal direction of the handle bar 47 by a predetermined width. The width of cutaway portions 47' is a half of circumference of handle bar 47. The cutaway portion 47' is preferably formed to have the same height as the thickness of the coupling portion 44. However, the height of the cutaway portion 47' may be larger or smaller than the thickness of the coupling portion 44.

The fitting ribs 47*a* that are respectively fitted into the fitting grooves 44*a* are provided along both ends of the cutaway portion 47'. The fitting ribs 47*a* protrude from both the ends of the upper or lower end of the handle bar 47 to face each other and are fitted downward and upward into the fitting grooves 44*a*, respectively.

In the meantime, a seating step 47*b* is formed at an inner end of each of the cutaway portions 47'. The seating steps 47*b* are formed at positions spaced apart by a distance corresponding to the thickness of the coupling portions 44 from the upper and lower ends of the handle bar 47. In a state where the fitting ribs 47*a* are fitted into the fitting grooves 44*a*, the seating steps 47*b* support upper and bottom surfaces of the bar holders 41 such that no relative movement between the bar holders 41 and the handle bar 47 occurs.

Hereinafter, the operation of the door handle for a refrigerator according to the present invention so configured will be described in detail.

Figure 4:
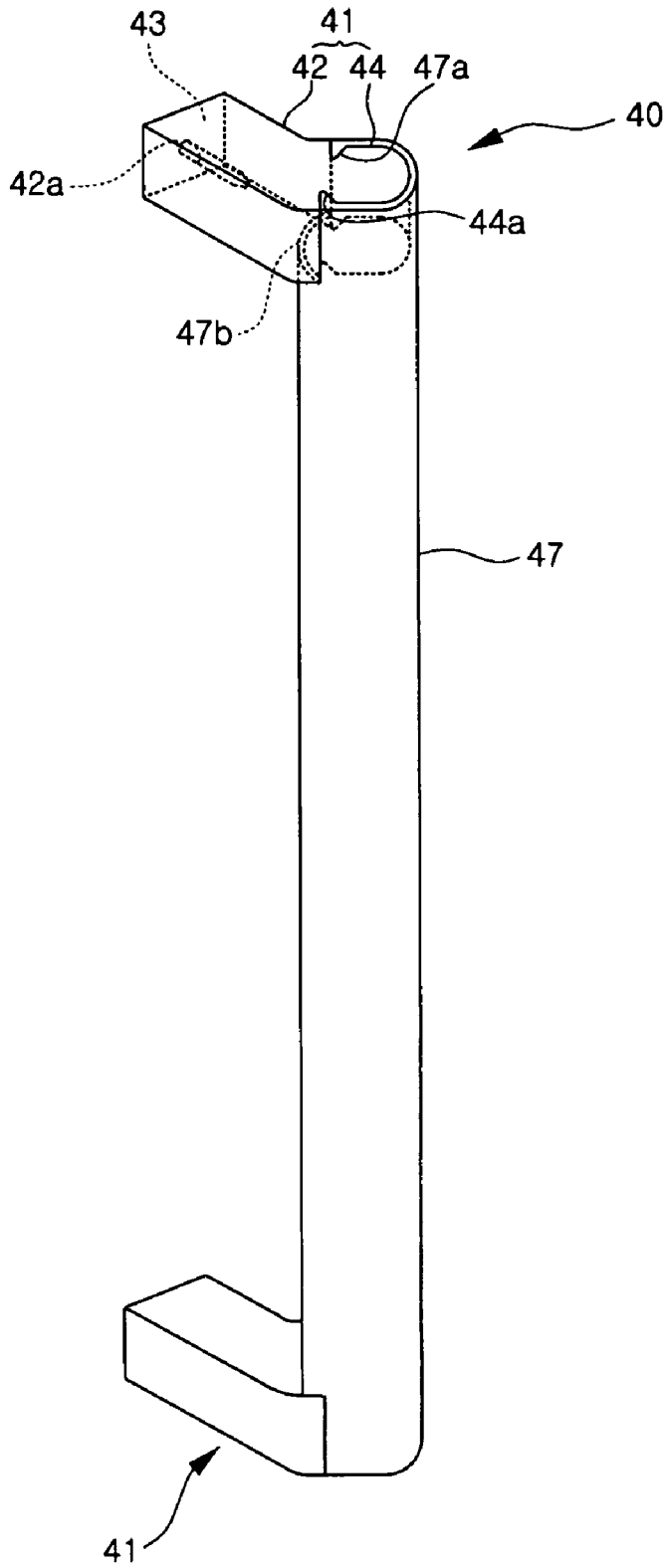
FIGS. 4 and 5 are views illustrating a process of assembling the embodiment shown in FIG. 2.
Figure 5:
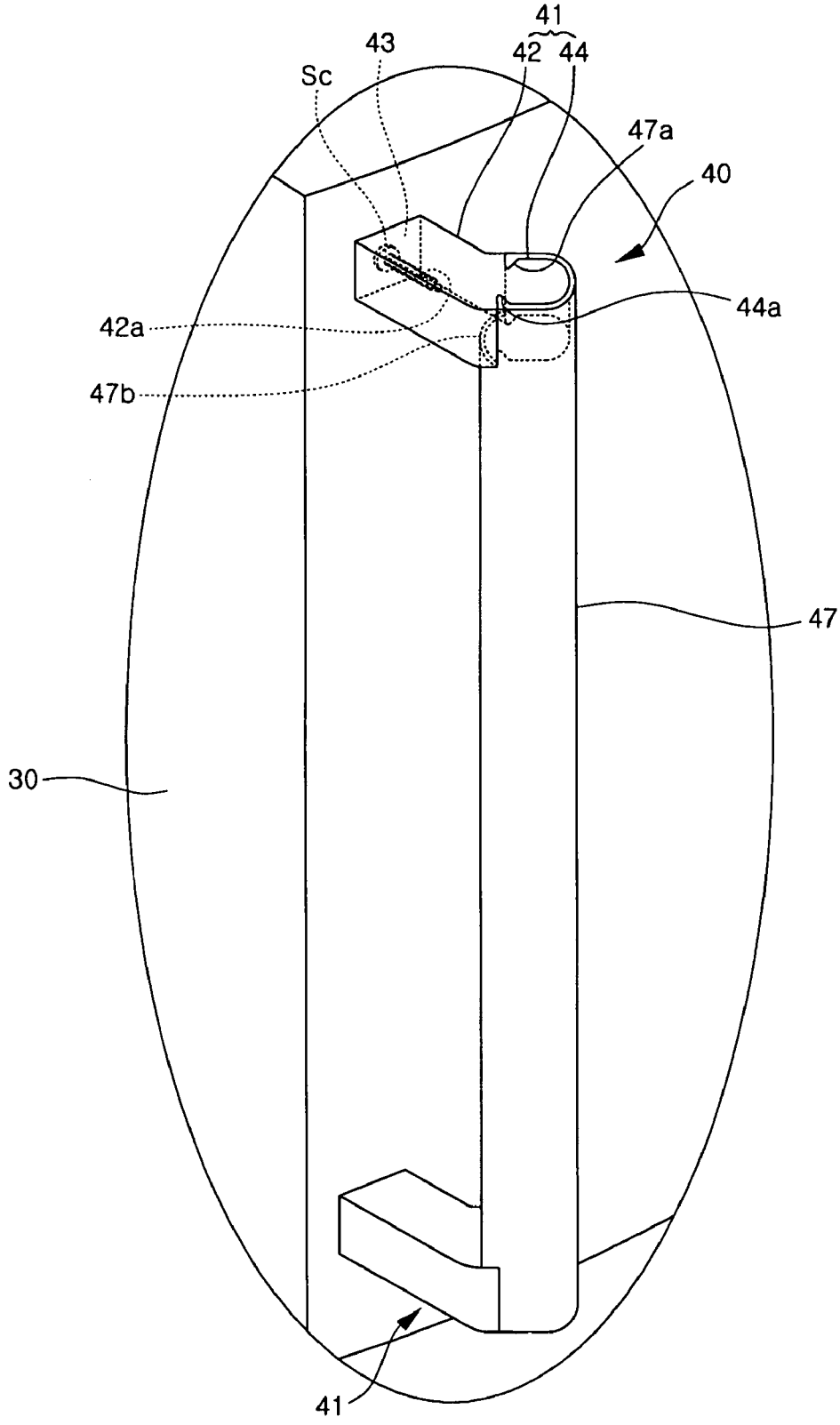

FIGS. 4 and 5 illustrate a process of assembling the preferred embodiment of the door handle for a refrigerator according to the present invention.

Referring first to FIG. 4, the coupling portions 44 of the bar holders 41 are inserted into the upper and lower ends of the handle bar 47, respectively. Among the bar holders 41, the coupling portion 44 of the bar holder 41 positioned at the upper position in the figure is downward inserted into the upper end of the handle bar 47 while the coupling portion 44 of the bar holder 41 positioned at the lower position in the figure is upward inserted into the lower end of the handle bar 47. At this time, the coupling portions 44 are press-fitted into the handle bar 47.

Also, when the coupling portions 44 are inserted respectively into the upper and lower ends of the handle bar 47, the fitting ribs 47*a* are inserted into the fitting grooves 44*a*. Since the fitting ribs 47*a* are fitted respectively into the fitting grooves 44*a* as described above, the handle bar 47 is not separated from the bar holders 41 even if the handle bar 47 is pulled.

It is preferred that the seating steps 47*b* of the handle bar 47 be supported on the upper and bottom surfaces of the bar holders 41 in a state where the bar holders 41 and the handle bar 47 are completely coupled to each other as described above.

Meanwhile, in the present invention, the bar holders 41 and handle bar 47 of the door handle 40 is assembled by means of their structural shapes without using additional fasteners. Therefore, the number of parts necessary for the assembly of the door handle 40 is reduced and the assembly can also be simplified.

Next, in order to fix the door handle 40 assembled in this way to the side of the front surface of the refrigerator door 30, the door contact surfaces 43 formed on the fixing portions 42 of the bar holders 41 are brought into close contact with the upper and lower portions on the front surface of the door 30, respectively, as shown in FIG. 5. Then, the screws Sc are fastened from the rear to the front of the door 30 into the fastening hole 42*a*formed in the fixing portion 42 through a fastening hole 31 formed in the front surface of the door 30. By fastening the screws Sc into the fastening holes 42*a* in this way, the door handle 40 is fixed onto the front surface of the door 30. The process of fixing the door handle 40 onto the door 30 using the screws Sc is performed before an insulation layer is formed in the door 30.

In the meantime, the positions of the fastening holes 41 and fastening holes 42*a* may not correspond to each other due to errors occurring while manufacturing the door 30 and door handle 40 or fixing the door handle 40 to the front surface of the door 30, e.g. when the fastening holes 41 are not bored at the desired positions or the handle bar 47 is formed to be shorter than the design value.

However, in the present invention, the bar holders 41 can move in the longitudinal direction of the handle bar 47. Thus, such an error can be corrected by moving the bar holders 41 upward or downward with respect to the handle bar 47. At this time, when a force is applied to the handle bar 47, the bar holders 41 can move only to the extent that the handle bar is not separated from the bar holders.

According to the door handle for a refrigerator of the present invention so configured, the following advantages can be expected.

First, since the bar holders and the handle bar are fastened to each other without using additional fasteners, the number of parts of the door handle is decreased. Therefore, the manufacturing costs can be reduced.

Further, since the assembly of the door handle is completed by fitting the bar holders into the upper and lower ends of the handle bar, the man-hour needed for the assembly works is reduced, and thus, the production costs are also reduced.

Furthermore, since the handle bar can move vertically by a certain distance with respect to the bar holders, an error occurring in the manufacturing or installing process can be overcome, and thus, the defect rate of the door handle can be decreased.

In addition, according to the present invention, the bar holders and handle bar are coupled with each other by means of their structural shapes and the screws used for fixing the bar holders to the door are fastened into the bar holders from the rear of the door. Therefore, since the screws etc. are not exposed to the outside, there is another advantage in that an external appearance of the door and door handle can be improved.

The scope of the present invention is not limited to the embodiment described and illustrated herein but is defined by the appended claims. It will be apparent to those skilled in the art that various modifications can be made thereto within the scope of the fundamental technical spirit of the invention. The scope of the present invention should be defined on the basis of the appended claims.

For example, although it has been described in the preferred embodiment that the bar holder 41 and handle bar 47 are generally shaped as hexahedron or rod, respectively, it is not necessarily limited thereto. The present invention can be implemented in such a manner that the coupling portion 44 of the bar holder 41 may be matched in shaped with the interior of the cutaway portion 47' of the handle bar 47 and the fitting ribs 47*a* may be fitted into and coupled to the fitting grooves 44*a*.

What is claimed is:

1. A door handle for a refrigerator, comprising:

a pair of bar holders each including a fixing portion mountable to an upper or lower portion on a side of a door and a coupling portion extending from the fixing portion;

a vertically extending handle bar including upper and lower ends into which the coupling portions are inserted and coupled, the handle bar having a substantially constant cross-section between the upper and lower ends, each of the upper and lower ends having a cutaway portion such that the cross-section of each upper and lower end is different from the substantially constant cross-section between the upper and lower ends; and fixing means including fitting grooves and fitting ribs provided in the bar holders and on the handle bar on the cutaway portions, respectively, at positions corresponding to each other to fix the bar holders to the handle bar, such that any one of the fitting grooves and fitting ribs are vertically fitted into or around the other when the coupling portions are inserted into the upper and lower ends of the handle bar.

2. The door handle as claimed in claim 1, wherein the fitting grooves are formed in each of the coupling portions adjacent to the fixing portions in a predetermined shape, and the fitting ribs are formed to protrude, in a shape corresponding to the fitting grooves, from both the upper and lower ends at the cutaway portions of the handle bar, into which the coupling portions are inserted.

3. The door handle as claimed in claim 2, wherein the fitting ribs and the fitting grooves are formed to extend in a longitudinal direction of the handle bar.

4. The door handle as claimed in claim 3, wherein a seating step is formed in each of the cutaway portions of the handle bar to be brought into close contact with a side of the coupling portion and supports a surface of the bar holder in a state where the coupling portions are inserted into the upper and lower cutaway portions of the handle bar such that the fitting ribs are fitted into the fitting grooves.

5. The door handle as claimed in claim 1, wherein a fastening hole is formed in a door contact surface of the fixing portion of each bar holder to be brought into close contact with the door, and the bar holder is fixable to the door by fastening a fastener into the fastening hole from the rear to the front of the door in a state where the door contact surface is brought into close contact with the upper or lower portion on a side of the door.

6. The door handle as claimed in claim 5, wherein the bar holders are mountable onto a front surface of the door.

7. The door handle as claimed in claim 1, wherein in a state where the bar holders are fixable to the door, the fixing portion of the bar holder extends to protrude from a front surface of the door, and the coupling portion of the bar holder extends to be curved at a predetennined angle with respect to the fixing portion in a direction away from a free end of the door.

8. The door handle as claimed in claim 1, wherein the handle bar has a hollow cylindrical shape.

9. A door assembly for a refrigerator, comprising:

a door having a free end;

a pair of bar holders each including a fixing portion fixed to an upper or lower portion on a side of a door and a coupling portion extending from the fixing portion;

a vertically extending handle bar including upper and lower ends into which the coupling portions are inserted and coupled, the handle bar having a substantially constant cross-section between the upper and lower ends, each of the upper and lower ends having a cutaway portion such that the cross-section of each upper and lower end is different from the substantially constant cross-section between the upper and lower ends; and fixing means including fitting grooves and fitting ribs provided in the bar holders and on the handle bar on the cutaway portions, respectively, at positions corresponding to each other to fix the bar holders to the handle bar, such that any ones of the fitting grooves and fitting ribs are vertically fitted into or around the others when the coupling portions are inserted into the upper and lower ends of the handle bar.

10. The door handle as claimed in claim 9, wherein the fitting grooves are formed in each of the coupling portions adjacent to the fixing portions in a predetermined shape, and the fitting ribs are formed to protrude, in a shape corresponding to the fitting grooves, from both the upper and lower ends at the cutaway portions of the handle bar, into which the coupling portions are inserted.

11. The door handle as claimed in claim 10, wherein the fitting ribs and the fitting grooves are formed to extend in a longitudinal direction of the handle bar.

12. The door handle as claimed in claim 11, wherein a seating step is formed in each of the cutaway portions of the handle bar to be brought into close contact with a side of the coupling portion and supports a surface of the bar holder in a state where the coupling portions are inserted into the upper and lower cutaway portions of the handle bar such that the fitting ribs are fitted into the fitting grooves.

13. The door handle as claimed in claim 9, wherein a fastening hole is formed in a door contact surface of the fixing portion of each bar holder brought into close contact with the door, and the bar holder is fixed to the door by fastening a fastener into the fastening hole from the rear to the front of the door in a state where the door contact surface is brought into close contact with the upper or lower portion on a side of the door.

14. The door handle as claimed in claim 13, wherein the bar holders are mounted onto a front surface of the door.

15. The door handle as claimed in claim 9, wherein in a state where the bar holders are fixed to the door, the fixing portion of the bar holder extends to protrude from a front surface of the door, and the coupling portion of the bar holder extends to be curved at a predetermined angle with respect to the fixing portion in a direction away from a free end of the door.

16. The door handle as claimed in claim 9, wherein the handle bar has a hollow cylindrical shape.

* * * * *